United States Patent [19]

Saroli

[11] Patent Number: 4,848,132

[45] Date of Patent: Jul. 18, 1989

[54] AUTOMOBILE BODY STRAIGHTENER

[76] Inventor: Aldo Saroli, 10,836 Pelletier Street, Montreal, North, Canada, H1H 3R6

[21] Appl. No.: 174,905

[22] Filed: Mar. 29, 1988

[51] Int. Cl.[4] ..... B21D 1/14

[52] U.S. Cl. ..... 72/447; 72/705

[58] Field of Search ..... 72/447, 705

[56] References Cited

U.S. PATENT DOCUMENTS

| | | | |
|---|---|---|---|
| 2,836,219 | 5/1958 | Pertner | 72/705 |
| 3,583,203 | 6/1971 | Williams et al. | 72/705 |
| 3,777,537 | 12/1973 | Samuelsson et al. | 72/705 |
| 3,893,329 | 7/1975 | Ross | 72/705 |
| 3,955,397 | 5/1976 | Meis | 72/705 |
| 4,271,692 | 6/1981 | Specktor | 72/705 |
| 4,309,895 | 1/1982 | Samuelsson | 72/705 |
| 4,313,335 | 2/1982 | Eck | 72/705 |
| 4,337,636 | 7/1982 | Clausen | 72/705 |
| 4,574,613 | 3/1986 | Doughty | 72/705 |
| 4,592,225 | 6/1986 | Eck | 72/705 |
| 4,712,417 | 12/1987 | Jarman et al. | 72/705 |
| 4,747,579 | 5/1988 | Rich | 72/705 |

FOREIGN PATENT DOCUMENTS

| | | | |
|---|---|---|---|
| 1121256 | 4/1982 | Canada | 72/705 |
| 2051724 | 4/1971 | Fed. Rep. of Germany | 72/705 |

*Primary Examiner*—Robert L. Spruill

[57] ABSTRACT

An apparatus for reblocking the panel body of a wrecked vehicle, comprising jack pads to immobilize the vehicle relative to the ground, a main upright post at a distance from the vehicle and pivoted to the ground about a vertical axis. A number of chains are mounted to the upright post and are adapted to be anchored to the panel body. A pair of vertically acting rams pull the chains anchored to the vehicle to reblock its panel body. The mounting of these chains on the upright post is characterized in that the vector of pulling force automatically adjusts to shifts in distribution of the load sustained in operation by concurrent rotation of the upright post about its vertical pivotal axis.

6 Claims, 8 Drawing Sheets

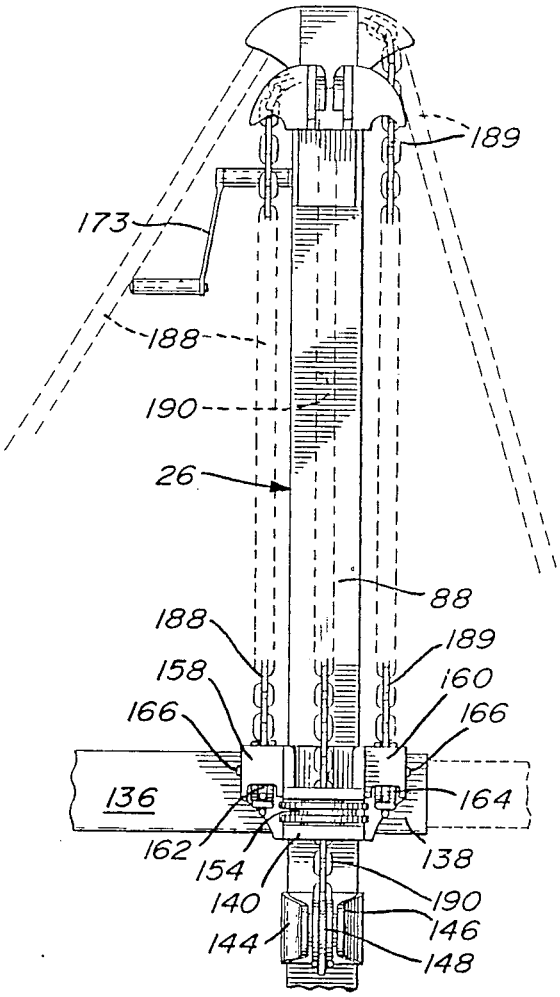
Fig. 8
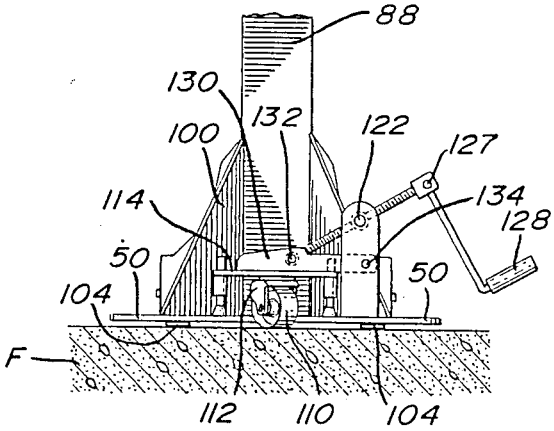

AUTOMOBILE BODY STRAIGHTENER

FIELD OF THE INVENTION

This invention generally relates to the tools used by ages and other repair shops for automobiles, and more particularly to the tools used in reblocking the panel body of a wrecked automobile.

BACKGROUND OF THE INVENTION

A number of automatic car panel body reblocking apparatuses, also called automobile body straighteners, have been developed in the last few years, in response to a still increasing demand from the automobile owners. However, a problem of level of adjustment of the tool relative to the damaged vehicle has been identified, as well as a safety hazard that is tied with the variable load sustained by this tool when the panel body is in the process of being reblocked, said variable load inducing backlashes of the pulling cables or chains forming part of the known body straighteners.

OBJECTS OF THE INVENTION

An object of the invention is to provide a tool for reblocking the panel body of wrecked automobiles, which can have an infinite range of positional adjustment relative to the automobile being repaired, and thus be more efficient.

A further object of the invention is to provide such a tool which will reduce the safety hazards generally associated with work in automobile panel body repair shops.

SUMMARY OF THE INVENTION

In accordance with the objects of the invention, there is disclosed a first embodiment of the invention consisting of an apparatus for reblocking the panel body of a wrecked vehicle, comprising means to immobilize said vehicle relative to the ground, a main upright frame member at a distance from said vehicle, pivot means to pivotally secure said upright member to the ground about a vertical axis, and pulling means mounted to said main frame member and adapted to be anchored to said panel body, said pulling means characterized in that its vector of force automatically adjusts to shifts in distribution of the load sustained in operation by concurrent rotation of said main frame member about said vertical axis of the pivot means.

Preferably, said main frame member defines a large upright post member provided with an enlarged flat base slidably supported on the ground, said pivot means comprising a pivot member vertically extending through said flat base and pivotally secured to the ground by releasable first anchoring means, the latter preventing upward disengagement of the post member relative to the ground.

Advantageously, said means to immobilize the vehicle includes a number of rigid jack pads provided with top grabber arms to grab the underside of both the panel body and the vehicle frame, said jack pads anchored to the ground by second anchoring means.

Profitably, both said anchoring means includes a common network of rail members, fixedly embedded into the floor in orthogonal fashion and each defining a top lengthwise slit opening into a cross-sectionally polygonal lengthwise channel; said first anchoring means defining a threaded bolt extending through said post flat base and through one of said slits and rotatably mounted into the latter with a correspondingly polygonal nut threadedly engaging the bolt; said second anchoring means similarly defining a pair of threaded bolts extending through a corresponding flat base of said jack pad and through another of said slits and fixedly mounted into the latter with correspondingly polygonal nuts threadedly engaging these latter two bolts.

According to an important aspect of the invention, said pulling means includes at least two separate pulling members and is characterized in that it is controlled under a continuously adjusted mode by power means. In this case, said main frame should include at least two vertically slidable tubes and two hydraulic rams to vertically displace corresponding said tubes; said pulling means including at least two chain members, each releasably meshingly anchored to projecting fingers at the top end of a corresponding said tube so as to be movable thereabout; ram control means being further provided for the operator of said apparatus.

Profitably, the intermediate section of one of said chain members meshes with a projecting fingers at the top of a corresponding tube; further including a first collar member, surrounding said tubes and vertically movable about said tubes and bearing two opposite vertical pulleys on two sides and a horizontal common pulley on a third side, the latter pulleys meshingly engaged by the two legs of said one chain member, and means to immobilize said first collar at a certain height.

Also profitably, one end section of the other of said chain members meshes with the projecting fingers at the top end of the other tube; further including a second collar member, surrounding said tubes and vertically movable about said tubes and bearing a vertical pulley meshingly engaged by the links of said other chain member, the latter vertical pulley in vertical register with said horizontal pulley of the first collar member; and means to immobilize said second collar at a certain height.

Preferably, there is further included a third chain member, fixedly secured at its top end to a link of said second chain member above the latter vertical pulley and engaging at its intermediate section sidewisely a small vertical pulley rotatably anchored to said main frame member in horizontal register with said horizontal pulley and to the underside of another small vertical pulley rotatably anchored to the bottom section of said main frame member.

In accordance with an alternate embodiment of the invention, the intermediate section of one of said chain members meshes with projecting fingers at a corresponding top end of a tube; wherein there is further included a first collar member, surrounding said tubes and vertically movable about said tubes and bearing a hollow polygonal block engaged by a correspondingly cross-sectionally polygonal transverse beam, said beam bearing at its two ends two pulleys mounted thereto by yoke means, whereby each of the latter pulleys is pivotable between a horizontal and a vertical plane, the latter pulleys meshingly engaged by the links of the two legs of said one chain member; and means to immobilize said first collar at a certain height.

It would be advantageous that said flat base of the post member be provided with at least three idle rollers, and that there be further included biasing means to bias said idle rollers from an extended operative position to a retracted inoperative position, wherein said post member is rollable on the ground when said idle rollers are in their operative position and when said first anchoring means is released, and is pivotally slidable on the ground around said pivot axis when said idle rollers are in their inoperative position and when said first anchoring means is engaged during operation of said apparatus.

Preferably, the latter biasing means includes: a yoke member rotatably carrying one of the idle rollers and dependent from the underface of a small plate carried by a pair of opposite feet supported by said flat base, said feet being of the telescopic type having spring means to bias same from a retracted position, in which said idle rollers rollingly abut against the ground, to an extended position, in which said idle rollers clear the ground; and means to downwardly push said small plate against the bias of said spring means.

Profitably, the latter means to push the small plate includes a pair of arms upstanding from said flat base and having a top interconnecting pivot stud member, said stud member having an intermediate threaded bore engaged by a threaded rod, said threaded rod pivotally mounted at its bottom end to the top central surface of said small plate and having at its top end a large operating hand lever.

Advantageously, said small plate is further pivotally mounted at one end to a pivot axle interconnecting the intermediate height section of said pair of arms. The latter pivot axle should remain on one side of the vertical plane passing through said arms top pivot stud relative to the pivotal mounting axis of said threaded rod bottom end with the top central surface of said small plate, during movement of said idle rollers from their operative to inoperative position, while it remains substantially below the horizontal plane passing through this pivot stud and pivotal mounting axis during same movement.

Preferably, said means to immobilize said first collar at a certain height includes a ratchet controlled winch, mounted to said post member above said first collar and having a cable anchored to said first collar; it could also further include a chain, releasably anchored at one end to said first collar.and at its bottom end to the bottom portion of said post member, to prevent upward backlash of the chain members under the load of the chain members in operation.

BRIEF DESCRIPTION OF THE DRAWINGS

FIG. 8 is a partly broken front elevational view of the post member of FIG. 5, with its front idle roller being biased in its downwardly extended ground-engaging position;

DETAILED DESCRIPTION OF THE INVENTION

Figure 1:
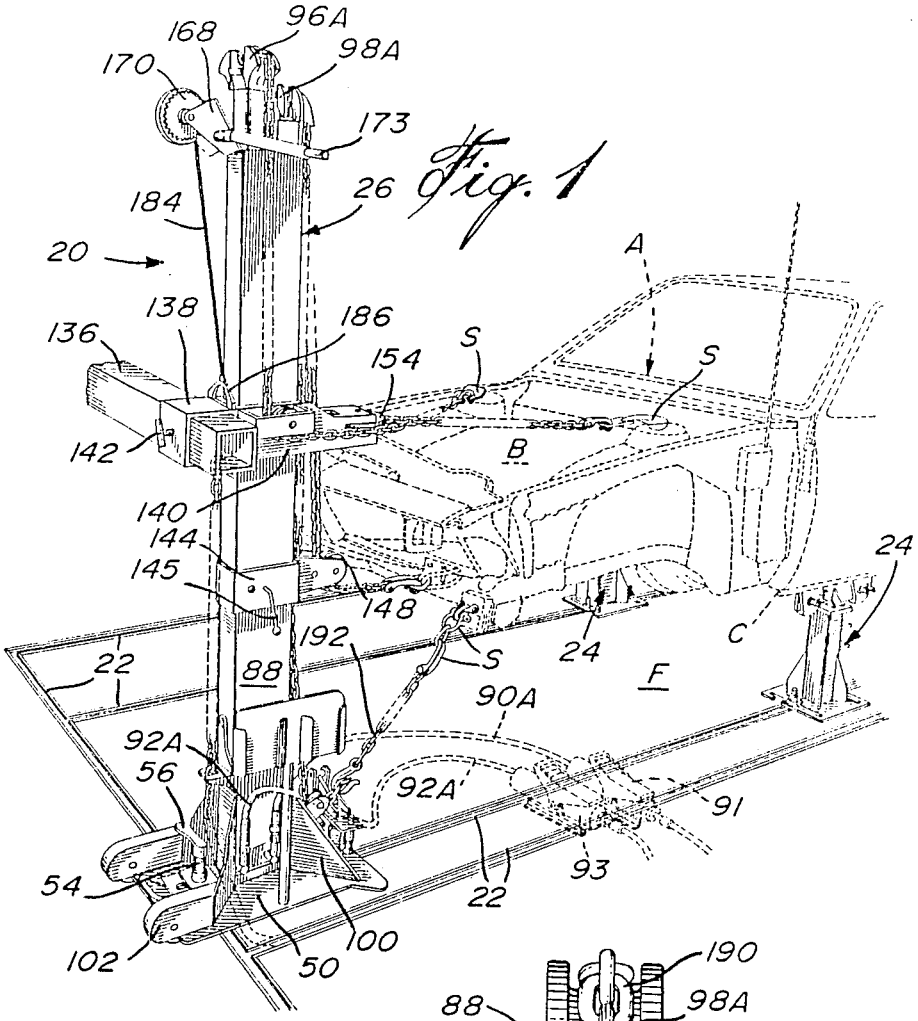
FIG. 1 is a perspective view of an automobile panel body straightener apparatus in accordance with the teachings of the invention, showing in dotted lines an automobile being supported over ground by the jack pads of the invention, and also showing in dotted lines the operator's pedals for actuating the rams within the vertical post member also forming part of the apparatus.
Figure 7:
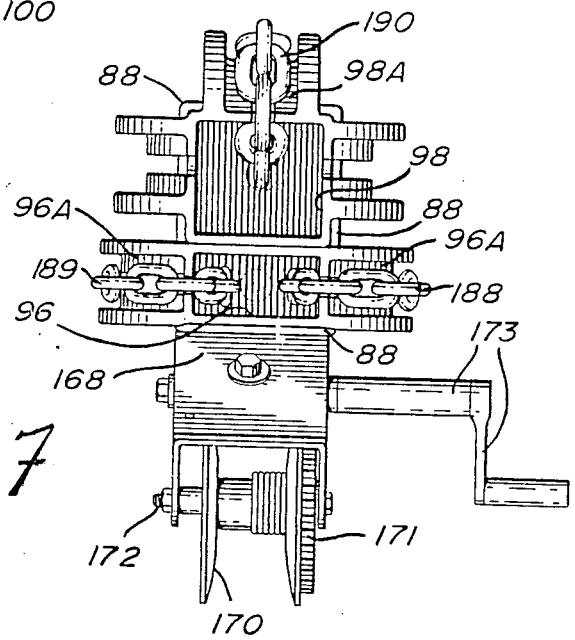
FIG. 7, shown on the first sheet of drawings, is a top end view of the vertical post member of FIG. 3.
Figure 2:
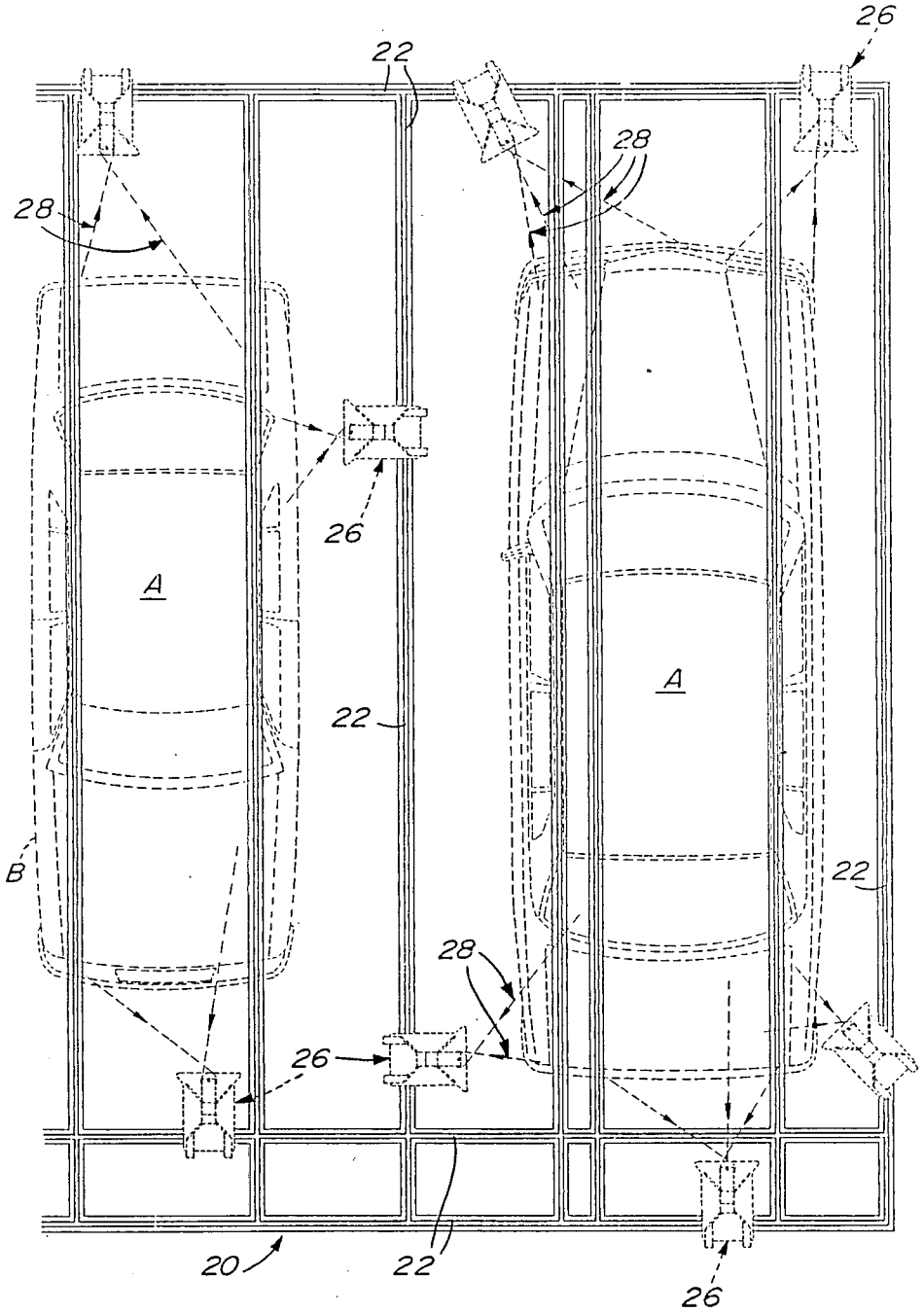
FIG. 2 is a schematic top plan view of the network of anchoring floor tracks included in the automobile panel body straightener apparatus in accordance with the teachings of the invention, also showing in dotted lines two automobiles being repaired and the plurality of vertical post members forming part of the invention anchored to the tracks and connected to the automobiles by the pulling means of the invention.
Figure 3:
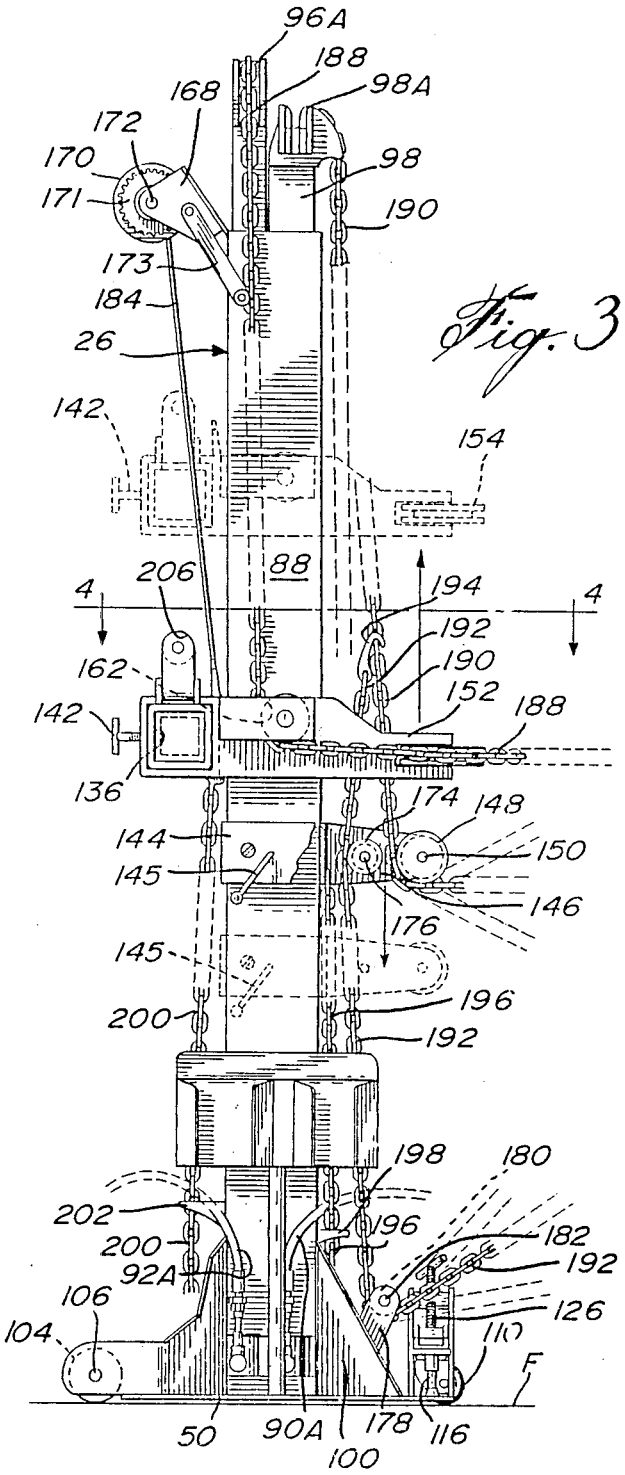
FIG. 3 is a side elevational view of one vertical post member forming part of the panel body straightener of the invention, showing in dotted lines the relative movement of the movable elements of the post member and also showing the various chains thereof partly in dotted lines for clarity of the view.

The automobile body straightener apparatus 20 is shown schematically in FIG. 2 and partially in FIGS. 1 and 3. Apparatus 20 consists of three main parts: a network of orthogonally disposed slots in the flooring F of a garage and forming tracks 22, a few jack pad members 24 slidably engaged into the tracks 22 and adapted to anchoringly support in fours the corners of the bottom frame C of an automobile A, and one or more vertical post members 26 pivotally anchored to the tracks 22. Each post member 26 includes a few pulling members 28 adapted to be releasably anchored to various parts of the panel body B of a wrecked automobile A, in order to bring the panel body B substantially into its original shape, that is to say, to pull the panel body B back into its fully extended condition from its squeezed condition resulting from collision.

Figure 10:
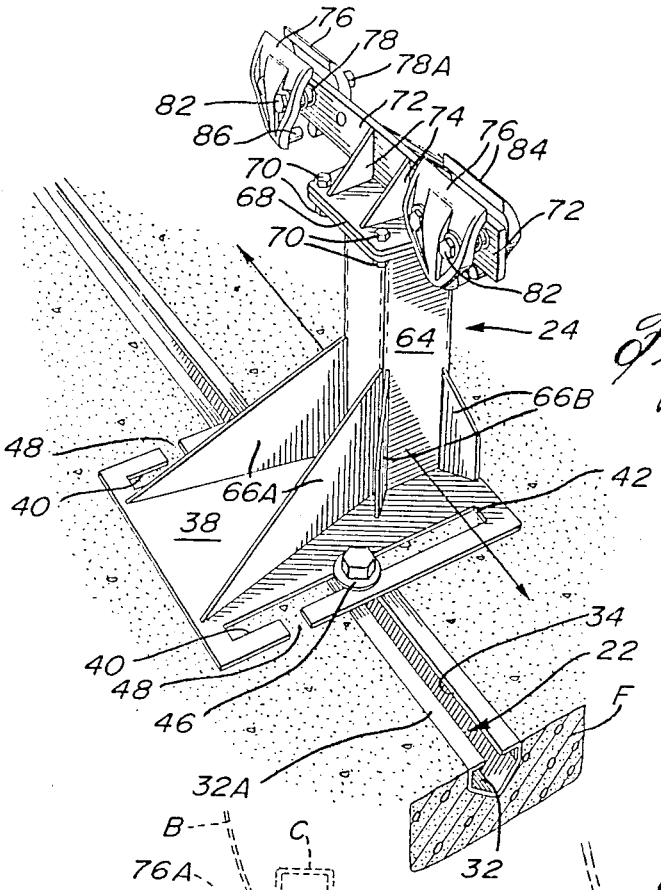
FIG. 10 is a perspective view of one jack pad member forming part of the invention, shown slidably anchored into a guiding rail embedded into the ground.
Figure 11:
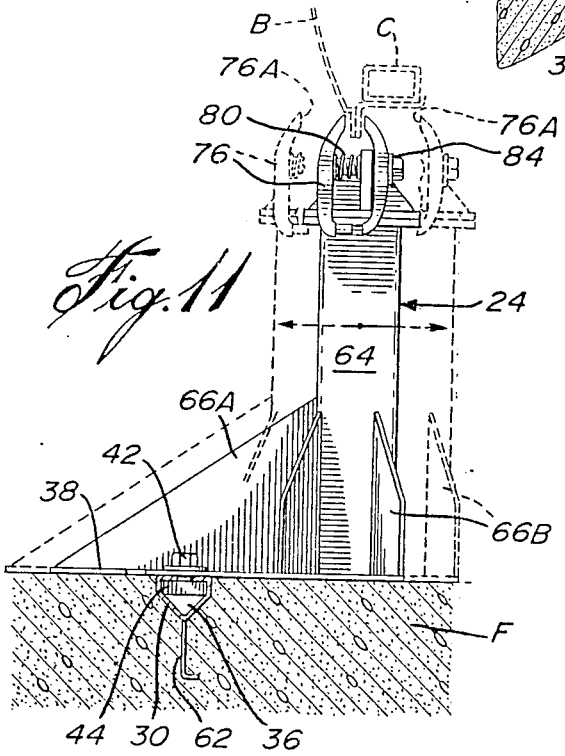
FIG. 11 is a side elevational view of the jack pad member of FIG. 10, showing the relative movement of the grabber arms thereof in phantom lines and the flooring rail tubing in cross-sectional view, and also suggesting how the lower flanges of the automobile panel body and bottom main frame, both in dotted lines, are to be anchored by the top grabber arms of the jack pad members.

The track 22 is shown in FIGS. 10 and 11 to be a substantially cross-sectionally pentagonal groove 30 made into the concrete flooring F, and into which is embedded a correspondingly shaped metallic tube 32 having a lengthwise slit 34 on its top face 32A, wherein an open lengthwise channel 36 is defined therebelow.

Each jack pad 24 member includes a bottom horizontal plate 38, slidable over the tube flat top face 32A and having a pair of parallel inner slits 40 each engaged by a large headed bolt 46. By engaging bolts 42 through the tube slit 34 and into the tube channel 36, and by positioning a nut 44 under each bolt 42 for threaded engagement therewith upon screwing the bolts, the jack pad 24 is therefore slidingly guided therealong. To adjust the position of the jack pad 24 relative to the automobile A, the jack pad 24 can be slided along track 22, for lengthwise adjustment, and for lateral adjustment, the operator needs only to pivot the base plate 38 so as to bring the slits thereof 40 transversely to the axis of the channel 36 wherein the base plate 38 can move transversely relative to the track 22. When the jack pad 24 is in appropriate position, the bolts 42 are tightly screwed to anchor the base plate 38 to the floor F. A washer 46 surrounds the stem of each bolt 42 above base plate 38 to prevent accidental disengagement of the bolts 42 through the base plate slit 40 in operation. A transverse aperture 48 in plate 38, opening into a corresponding slit 40, facilitates engagement/disengagement of the bolt 42 from the slit 40 for maintenance purposes.

Similarly, each post member 26 includes a bottom supporting plate 50 (FIGS. 1, 5 and 6) having a bore 52 engaged by a reinforced threaded rod 54 which again extends freely through the flooring tube slit 34 and screwingly into a large nut 44 into the lengthwise channel 36 of tube 32. An elongated transverse lever 56 is integrally mounted to the top end of rod 54, to facilitate screwing/unscrewing thereof; or, the mounting of lever 56 could be of the ratchet type relative to rod 54, wherein post 26 can be solidly anchored to the ground F. Again, use of a washer 46 above of the post member bottom plate 50 and around each rod 54 is preferred, with an intermediate nut 58 anchoring a washer 46 to plate 50. Also, ground tubes 32 may be provided at their apex with a downwardly extending cross-sectionally T-shaped anchoring base leg 60 or elongated anchoring bolts 62, being embedded into the concrete of flooring F.

Figure 12:
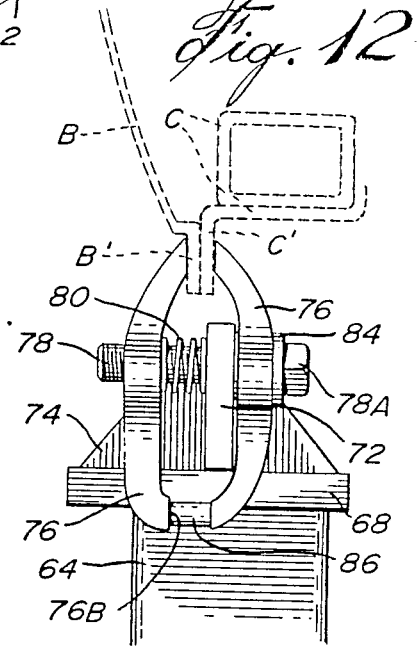
FIG. 12 is an enlarged view of the top portion of FIG. 11, showing the grabber arms firmly taking in sandwich the lower flanges of the car panel body and car main lower frame.

The jack pads 24, which support the frame C of an automobile A so that the latter clears the ground F when its wheels are removed, is detailed in FIGS. 10, 11 and 12. A short upright strut 64 is anchored to one end of the base plate 38, midway between the pair of opposite slits 40, and radially anchored to various corners of the plate 38 by vertical wedge plates 66A, 66B. Wedge plates 66A are much longer than wedge plates 66B and are designed to support strut 64 on the side opposite that on which the automobile A will be suspended. To the top end of strut 64 is anchored a pair of horizontal plates 68 anchored to each other by corner bolts 70 and centrally supporting a vertical metallic plank 72 maintained in position over plates 68 by wedge plates 74 similar to but smaller than wedge plates 66A-66B. Plank 72 extends transversely to slits 40 of the base plate 38. To each end of plank 72 are mounted a pair of opposite grabber arms 76, threadedly through a pair of bolts 78 extending threadedly through plank 72 and screwed to both arms 76. Each arm 76 is arcuate or C-shaped with one facing the other so that their inturned ends 76A register with each other. A coil spring 80 is provided around each bolt 78, on one side of plank 72, to bias each each pair of grabbers 76 away from each other.

In operation, the top inturned ends 76A of the grabber arms are adapted to take in sandwich the bottom flange B′ of the panel body B and the downturned exterior flange C′ of the automobile bottom frame C, and the bolts 78 are to be screwed to firmly anchor parts B′ and C′ together. Coil springs 80 are provided to induce a widening of the top mouth of the grabbers 76 (defined by their top ends 76A), in order to facilitate engagement of automobiles flanges B′ and C′. Between the head 78A of each bolt 78 and the exterior face of one grabber 76, and between a locking nut 82 and the exterior face of the other grabber 76 of a given pair of grabbers 76, is mounted a washer 84 around the bolt 78. To the bottom inturned ends 76B of a pair of grabber arms 76 are mounted a pair of small registering studs 86, which are of such a length as to abut against each other when the top inturned ends 76A of the grabber arms have firmly taken in sandwich automobile parts B′ and C′; thus, there will not be any pivotal action about a horizontal plane passing through bolts 78, even though the pressure of top grabber ends 76A against automobile parts B′, C′ does (unsuccessfully) induce the bottom grabber ends 76B to spread apart.

We will now examine in detail the vertical post members which make up the heart of the invention. The base plate 50 fixedly supports an elongated (say about two meters high) upright hollow post 88, being cross-sectionally quadrangular. A pair of rams 90, 92 are anchored to base plate 50 by flat bottom stays 94, within the hollow of post 88, to vertically displace a pair of elongated hollow tubes 96, 98 respectively mounted within the hollow of main post 88 above rams 90, 92 for a purpose later set forth. Rams 90, 92 are hydraulically controlled by corresponding exterior pedal members 91, 93 via hydraulic lines 90A, 92A. Pedals 91, 93 are adapted to be controlled by a single operator. From the lower portion of main post 88 depends a few reinforcing vertical wedge plates 100 anchored to base plate 50, and with some of which being integrally mounted to a pair of "rear" upright casings 102 into each of which is rollably mounted an idle roller 104 about a horizontal axis at axle 106. As clearly seen in FIGS. 5–6, the bottom peripheral edge 104A of the idle rollers 104 supported by axles 106 extend below the horizontal plane defined by base plate 50, wherein a spacing or gap 108 may exist between the base plate 50 of the post member 26 and the top face 32A of the ground embedded channel tube 32. A third "front" idle roller 110 is rollably mounted to a yoke 112 itself downwardly depending from a small plate 114 which is anchored to the post base plate 50 by short telescopic legs 116, see FIGS. 8 and 9.

Figure 4:
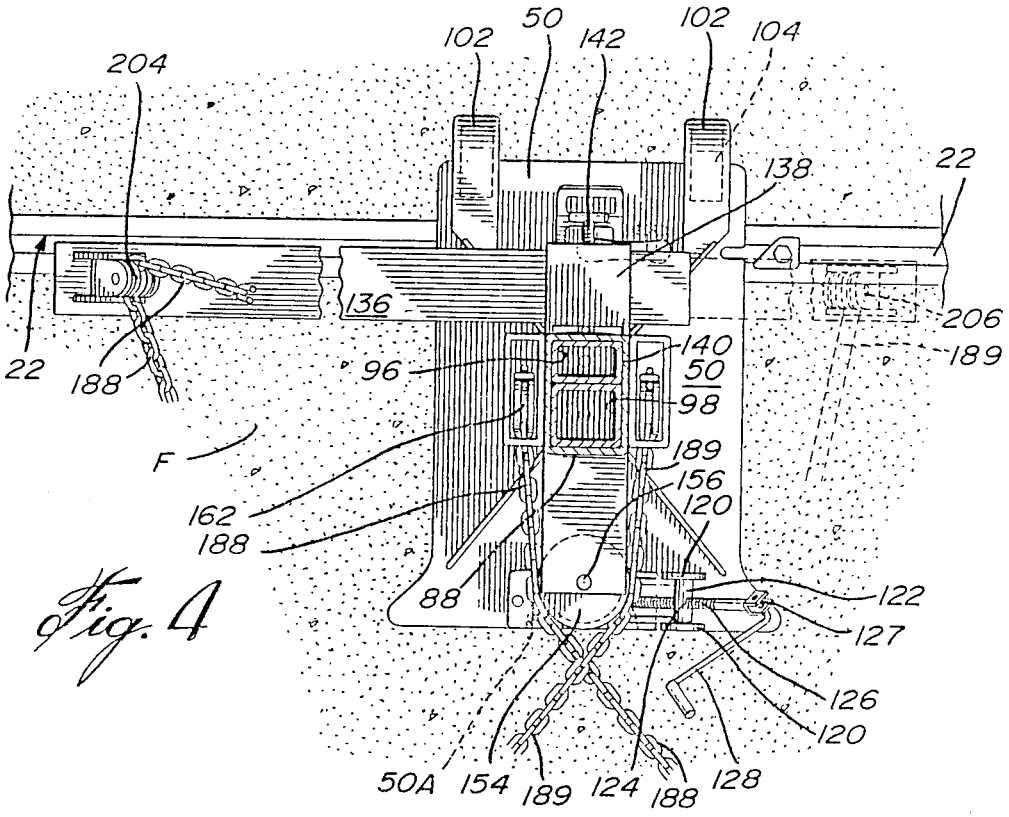
FIG. 4 is a cross-sectional view taken along line 4—4 of FIG. 3 or of FIG. 6.

Rollers 104, 110 are provided to facilitate displacement of post 88 when not in operation, by allowing rolling action of post 88 along the floor F. Each leg 116 is biased in its telescopically extended position by internal known spring means (not shown), whereby the bottom peripheral edge of idle roller 110 clears upwardly the horizontal plane defined by base plate 50, which is to say, allows the front section of plate 50 to flatly abut against the ground F as clearly shown in FIG. 9. (Roller 110 extends through a front cavity 50A made in bed plate 50, see FIG. 4)

Figure 9:
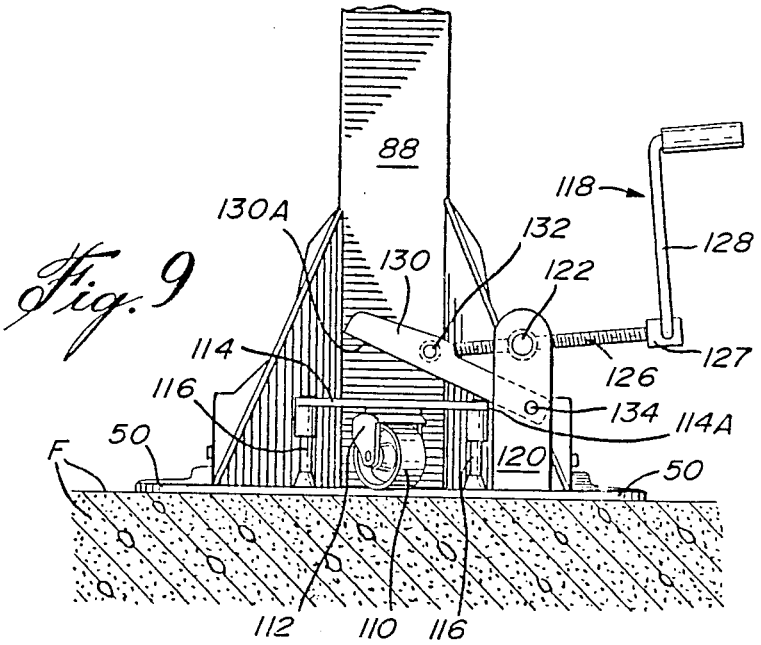
FIG. 9, shown on the fourth sheet of drawings, is an enlarged view of the lower portion of the post member of FIG. 8, but with the front idle roller thereof being in its upwardly released ground-clearing position.

Now, biasing means 118 are provided to downwardly bias horizontal plate 114 against the bias of telescopic legs 116, wherein idle roller 110 is biased downwardly through the horizontal plane defined by base plate cavity 50A toward and against the floor F, to thereafter lift the front section of base plate 50 above ground so that post member 24 be supported over ground solely by rollers 104 and 110, see FIG. 8. These biasing means 118 are clearly shown in FIGS. 4, and 9, and include: a pair of upright arms 120, anchored to base plate 50 in register with plate 114 and registering with each other about a "front to rear" axis; a pivot stud 122 interconnecting the top ends of arms 120 and having a central transverse threaded bore 124; a threaded rod 126, threadedly engaged into said stud central bore 124; a large hand lever 128 pivotally mounted at one end 127 of rod 126 for rotating same; and a rigid pad 130, pivoted at its central portion 132 to the other end of rod 126 and also pivoted at one end 134 to a mid-height section of upright arms 120. Hence, the underface 130A of pad 130 is adapted to flatly abut against plate wall 114 when roller 110 is fully downwardly extended (FIG. 8), but to abut only wedgewisely against the inner side edge 114A of plate 114 when roller 110 is biased by telescopic legs 116 to its upwardly retracted position (FIG. 9). This is possible only if:

(a) pivot 134 remains slightly below the horizontal plane passing through plate 114;

(b) pivot 132 remains within the two horizontal planes passing through top pivot 122 and through bottom pivot 134, respectively;

(c) pivot 127 remains above the level of pivot 122; and (d) pivots 127 and 134 remain on one side of pivot 122 and pivot 132 on the other side of same pivot 122.

Hence, by manually rotating rod 126 with handle 128, the operator will be able to pivot pad 130 about axis 134 from a position where it only marginally biases plate 114 (FIG. 9) (wedgewisely) wherein idle roller 110 is in its upwardly retracted position, to a position where it abuts flatly against the major portion of the surface of plate 114 (FIG. 8); and vice-versa.

Figure 5:
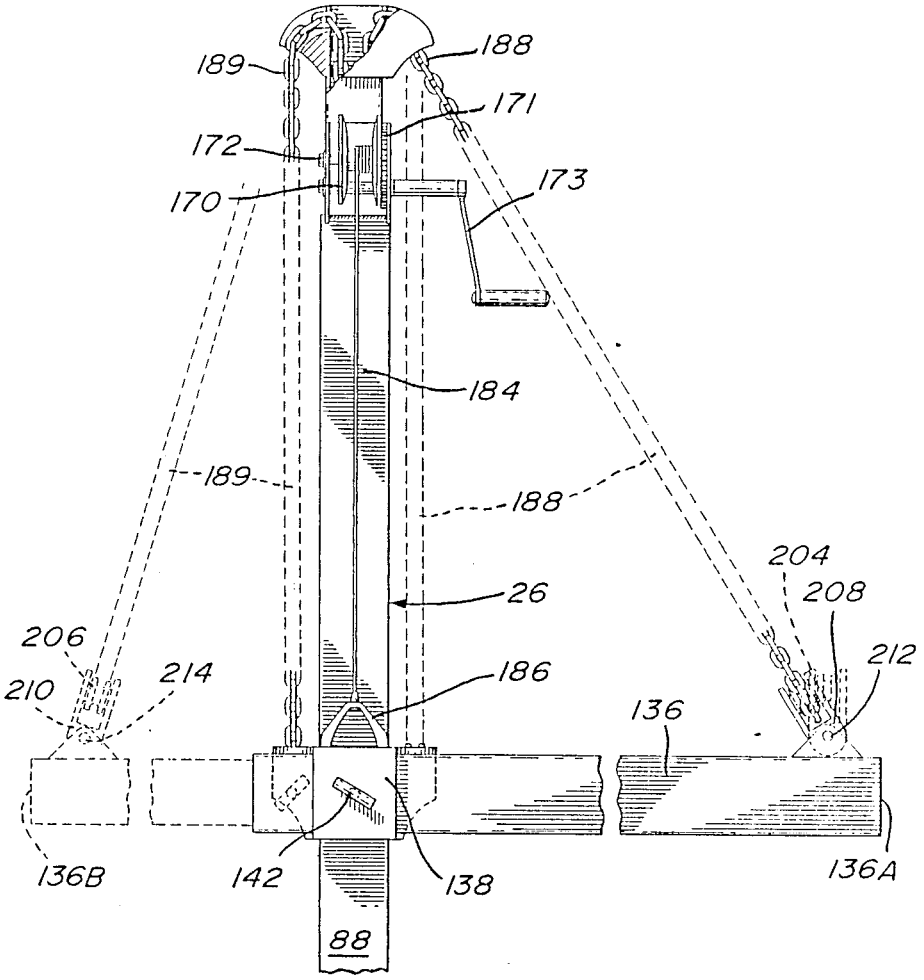
FIG. 5 is a partly broken rear elevational view of the post member of FIG. 3, and also showing in longitudinal sectional view the flooring tube guide rail embedded into the ground, and a large transverse beam connected to the post member partly broken and partly in phantom lines, wherein the two downwardly dependent chains are shown in dotted lines to be connected to either a first pair of vertical pulleys, proximate to the post member, or to a second pair of pivoted pulleys, at the two ends of the transverse beam.
Figure 5:
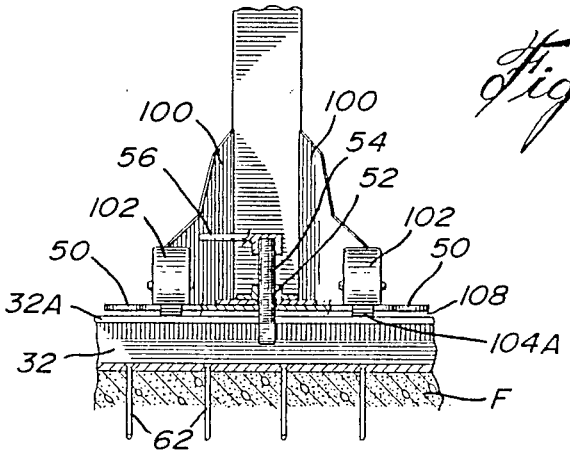
Figure 6:
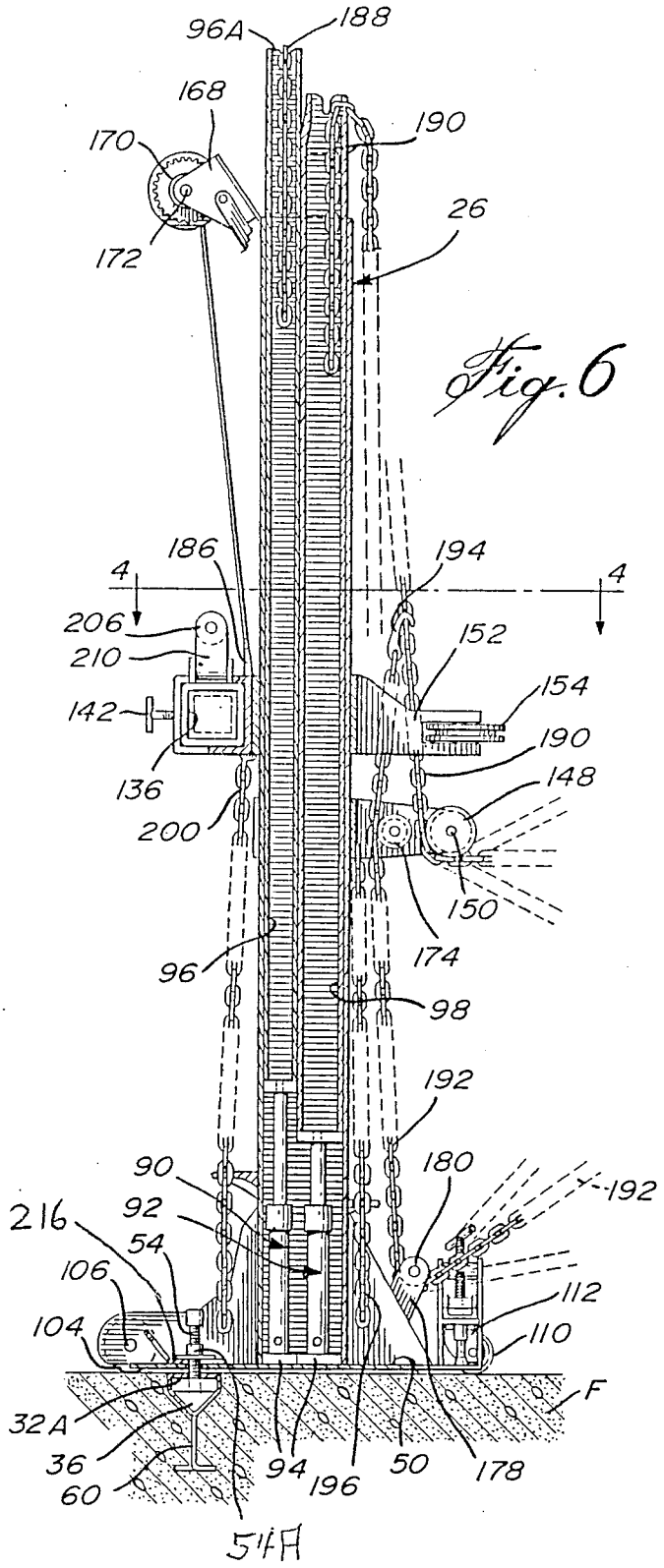
FIG. 6 is a sectional side elevational view of the vertical post member of FIG. 5.

As suggested in FIGS. 1, 5 and 8, the upright tubes 88 from two post members 26 may be interconnected by a transverse hollow beam 136, of quadrangular cross-section, being slidingly engaged through a quadrangular block 138 integrally mounted to a metal anchoring quadrangular collar 140 itself of a shape for being slidably mounted about post 88. The beam 136 can be immobilized into block 138 by screwing a large set screw 142 (extending through a threaded bore made through the outer wall of block 138) thereagainst. A second smaller metal collar 144, being also quadrangular, is slidably mounted about post 88 below collar 140, and can be locked in place by a large headed pivotable lever set screw 145.

A vertical yoke 146 frontwardly depends from collar 144 and rollably supports a vertical pulley 148 rotatable about a horizontal axis 150. A horizontal yoke 152 frontwardly depends from collar 140 and rollably supports a horizontal pulley 154 rotatable about a vertical axis 156 passing through the plane of rotation of lower vertical pulley 148. Two opposite vertical yokes 158, 160 further sidewisely depend from collar 140 and rollably support vertical pulleys 162, 164 respectively rotatable about a common horizontal axis 166. Still another yoke 168 rearwardly upwardly extends from the top rear edge of post 88, and rollably supports a vertical pulley forming a winch 170 rotatable about a horizontal axis 172. A ratchet system 171 and a rotatable handle 173 enable operation of the winch 170.

A still further vertical pulley 174 is supported by a yoke 146, between pulley 148, and post 88; pulley 174 is about half the diameter of pulley 148, is coplanar therewith and is rotatable about a horizontal axis 176. A vertical yoke 178 is anchored to base plate 50, in vertical register with pulleys 148 and 174 and forwardly upwardly (outwardly) extending relative to post 88, and supports a pulley 180 rotatable about a horizontal axis 182.

In operation, metal collar 140 is brought in proper position by rotating winch 170 with lever 173, which winds a rope 184 tied by a hook 186 to anchor block 138. The first and second half-section legs 188, 189 of a first chain 187 lockingly extend over the top curved notched end 96A of inner tube 96, down on the sides of post 88, under vertical pulleys 162-164 respectively and sidewisely of horizontal pulley 154 to frontwardly extend crosswisely to be anchored at both ends to two spaced parts of body B, as shown in FIG. 1. A second chain 190 lockingly extends over the top curved notched end 98A of tube 98, down the front of post 88, between horizontal pulley 154 and post 88, down around lower pulley 148, to frontwardly extend to be anchored at another section of the panel body B. A third chain 192 engages around bottom pulley 180, upwardly along the front side of post 88, sidewisely engaging pulley 174 proximate the front side of post 88, and anchored by a hook 194 to a section of chain 190 intermediate the levels of pulley 148 and the top end 98A of inner tube 98. A fourth chain 196 anchors the front section of collar 144, adjacently to post 88, adjustably to a bottom anchoring finger 198 transversely projecting from the bottom portion of the front wall of post 88 in register with a wedge plate 100. A fifth chain 200 anchors the rear section of collar 140, adjacently to post 88, adjustably to a bottom anchoring finger 202 transversely projecting from the bottom portion of the rear wall of post 88 in register with a wedge plate 100.

In the alternate embodiment of the invention, best shown in FIG. 5, the two chain legs 188, 189 instead of engaging pulleys 162, 164 along a somewhat parallel travel and of sidewisely engaging their common horizontal pulley 154, now diverge toward the two ends 136A, 136B of the transverse beam 136, to rollingly engage around corresponding pulleys 204, 206 rollably anchored by yokes 208, 210 pivotally to ends 136A, 136B at top pivot axles 212, 214. From pulleys 204, 206 frontwardly extend the chain legs 188, 189. The distance between one pulley 204 or 206 relative to post 88 can accordingly be varied by sliding beam 136 into block 138, and thereafter locking same in position with set screw 142.

Hence, in accordance with the heart of the invention, rams 90, 92 are actuated by outer pedals 91, 93 to lift inner tubes 96, 98 with locking pad 130 being released to lift roller 110 wherein base 50 is allowed to flatly abut against floor F. Chains 187, 190 and 192 are thus all pulled, so that a tension is applied on the sections of the car panel B which are anchored to these three chains in the conventional way by friction clamps S and the like. Thereafter, post member 88 will most ingeniously pivot around anchoring bolt 54 (which is on the side of post 88 opposite that one facing the vehicle A sustaining the pulling forces) to bring pulleys 148, 162, 164 and 180 (or alternately, in accordance with the alternate embodiment of the invention, pulleys 148, 204, 206 and 180 about a vertical plane exactly orthogonal to the vertical plane of the desired pulling force vector designed to straighten the panel body B. This will provide a most efficient pulling effort, in that the post member 88 will always adjust its position "automatically" relative to the vector of the pulling force, which as is well known will tend to shift in operation because of the gradual straightening of the body panel B during pulling action deformation thereof.

The fact that there are two rams 90, 92 will further provide a pulling force in a selective way, that is to say, the pulling of the two legs 188, 189 of chain 187 can be effected in a continuous mode, either independently or concurrently with that of chain 190 and associated chain 192 (also in a continuous mode).

The purpose of chains 196, 200 as can now be gathered, is to prevent upward backlash of collars 144, 140 respectively, under the load of the pulling forces sustained thereabout. Also, the action of a front horizontal pulley 154 permits not only to displace the torque of the pulley force along a substantially common vertical plane, passing through pulleys 154, 148, 162 and 164, for a concerted pulling action, but also facilitates cooperation of the two legs 188, 189 of chain 187 which sidewisely engages it.

It should be understood that other embodiments are envisioned to come within the scope of the present invention. For instance, a top transverse beam may be mounted at one end section to the top ends 96A, 98A of rams 96, 98. This latter beam could be anchored at one end to a ground fixed structure, and be provided at the other end thereof with a hook member. Upon lifting ram 96, the beam will pivot upwardly to lift a load that would be hanged to the latter hook. Ram 98 could then be lifted so that the beam be supported at two points instead of one, wherein high loads could be supported for a long time.

I claim:

1. An apparatus for reblocking the panel body of a wrecked vehicle, comprising means to immobilize said vehicle to the floor, a main upright frame member at a distance from said vehicle, pivot means to secure said upright member to the floor pivotally about a vertical axis, and pulling means mounted at one end to said main frame member and adapted to be anchored at the other end to said panel body, said pulling means characterized in that its vector of force automatically adjusts to shifts in distribution of the load sustained in operation by concurrent rotation of said main frame member about said vertical axis of the pivot means; said pulling means including at least two separate pulling members and is characterized in that it is controlled under a continuously adjusted mode by continuous power means; said main frame further including at least two vertically slidable tubes and two hydraulic rams thereunder to vertically displace these tubes; said pulling means including: at least two chain members, each defining an intermediate section which is releasably mounted to the top end of a corresponding said tube so as to be movable therewith and two legs on opposite sides of said intermediate section, and ram control means to enable control of the pulling force of said pulling means by an operator; wherein the links defined at the intermediate section of one of said chain members mash with arcuately disposed fingers upwardly projecting from the top end of a corresponding tube; further including a first collar member, surrounding said tubes and vertically movable relative thereto and bearing two vertical pulleys on two opposite sides thereof and a horizontal common pulley on a third side thereof, said horizontal pulley meshingly engaged by the links of the two legs of said one chain member; and means to immobilize said first collar at a certain height.

2. An apparatus for reblocking a wrecked vehicle as defined in claim 1.

wherein the links at one end section of the other of said chain members meshes with arcuately disposed fingers upwardly projecting from the top end of the other tube; further including a second collar member, surrounding said tubes and vertically movable relative thereto and bearing a vertical pulley meshingly engaged by the links of said other chain member, the latter vertical pulley in vertical register with said horizontal pulley of the first collar member; and means to immobilize said second collar at a certain height.

3. An apparatus for reblocking a wrecked vehicle as defined in claim 2, further including a third chain member, fixedly secured at its top end to an intermediate section of said second chain member above said vertical pulley of the second collar and meshing at its intermediate section sidewisely with a small vertical pulley, the latter pulley rotatably anchored to said main frame member in horizontal register with said vertical pulley, said third chain member also meshing with the underside of another small vertical pulley rotatably anchored to the bottom section of said main frame member, the other end of said third chain member being connected to said wrecked vehicle.

4. An apparatus for reblocking a wrecked vehicle as defined in claim 1, wherein the links at the intermediate section of one of said chain members mesh with arcuately disposed fingers upwardly projecting from the top end of a corresponding tube; further including a first collar member surrounding said tubes and vertically movable relative thereto and bearing a hollow polygonal block engaged by a correspondingly cross-sectionally polygonal horizontal transverse beam, said beam bearing at its two ends two pulleys mounted thereto by yoke means whereby each of the latter pulleys is pivotable between a horizontal and a vertical plane, the latter pulleys meshingly engaged by the links of the two legs of said one chain member; and means to immobilize said first collar at a certain height.

5. An apparatus for reblocking a wrecked vehicle as defined in claim 4, wherein said means to immobilize said first collar at a certain height includes a ratchet controlled winch, mounted to said post member above said first collar, and a cable anchored to said first collar and windably mounted to said winch.

6. An apparatus for reblocking a wrecked vehicle as defined in claim 5, wherein said means to immobilize said first collar at a certain height further includes a chain releasably anchored at its top end to said first collar and at its bottom end to the bottom portion of said post member, to prevent upward backlash of the chain members under the load of the chain members in operation.

* * * * *